US006715174B2

(12) United States Patent
Tsai

(10) Patent No.: US 6,715,174 B2
(45) Date of Patent: Apr. 6, 2004

(54) SELF INFLATED AIR CUSHIONED BED

(76) Inventor: Jen-Hsiu Tsai, 2F-3, No. 11, Lane 250, Sec. 5, Nanking E. Rd., Taipei (TW)

( * ) Notice: Subject to any disclaimer, the term of this patent is extended or adjusted under 35 U.S.C. 154(b) by 0 days.

(21) Appl. No.: 10/237,760

(22) Filed: Sep. 9, 2002

(65) Prior Publication Data

US 2004/0045090 A1 Mar. 11, 2004

(51) Int. Cl.[7] ..... A47C 27/14; A47C 27/10; A47C 16/00

(52) U.S. Cl. ..... 5/709; 5/710; 5/655.3

(58) Field of Search ..... 5/654, 710, 709, 5/655.3, 708

(56) References Cited

U.S. PATENT DOCUMENTS 4,134,424 A * 1/1979 Zeyra et al. ..... 137/493
4,541,136 A 9/1985 Graebe
5,029,939 A * 7/1991 Smith et al. ..... 297/284.1
5,111,544 A 5/1992 Graebe
5,379,471 A * 1/1995 Holdredge ..... 5/655.3
5,596,781 A * 1/1997 Graebe ..... 5/710
5,632,055 A * 5/1997 Graf ..... 5/706
6,185,770 B1 * 2/2001 Wang ..... 5/706
6,219,868 B1 * 4/2001 Wang ..... 5/709
6,321,404 B1 11/2001 Tsai
6,367,106 B1 * 4/2002 Gronsman ..... 5/709

* cited by examiner

*Primary Examiner*—Heather Shackelford
*Assistant Examiner*—Lisa M. Saldano
(74) *Attorney, Agent, or Firm*—William E. Pelton, Esq.

(57) ABSTRACT

A self inflated air cushioned bed includes a base, multiple air units each provided with at least two air cells securely mounted on top of a substrate and at least one unidirectional valve mounted on the substrate to allow air to flow into the at least two air cells, and an expanding device received in each one of the at least two air cells in each of the multiple air units to maintain the at least two air cells in each of the air units to be expanded. When the at least two air cells of each of the air units are expanded due to the expanding device, the at least one unidirectional valve allows air to flow into the at least two air cells of each of the air units so that the air units are maintained inflated.

8 Claims, 13 Drawing Sheets

SELF INFLATED AIR CUSHIONED BED

BACKGROUND OF THE INVENTION

1. Field of the Invention

The present invention relates to an air cushioned bed, and more particularly to a self inflated air cushioned bed having an expanding device received in each of the air units that form the air cushioned bed.

2. Description of Related Art

With reference to FIG. 10, an inflatable air cushion (80) disclosed in U.S. Pat. No. 4,541,136 and U.S. Pat. No. 5,111,544 has a base (82) and multiple air units (84) integrally formed and communicating with one another. The air units (84) are mounted on top of the base (82) so that the air inside the air units (84) provide a cushion to a load on top of the air cushion (80). Because the air units (84) are integrally formed, it is necessary for the manufacturer to use another mold to make another air cushion with different dimension, which increases the fabrication cost. Furthermore, although this kind of air cushion (80) is able to prevent the user from having bedsore, once the user, especially the elders, disables or sick ones, has bedsore, the user is not able to use the air cushion any more. Again, if there is any one of the air units is broken, the entire air cushion will have to be replaced, which shortens the life span of this air cushion.

To overcome the shortcomings, a second air cushioned bed is introduced. With reference to FIG. 11, the air cushioned bed has a base (90) and multiple air units (92) detachably mounted on top of the base (90) via a hook and loop combination (94). Preferably, the hook and loop combination is a Veloro™. The provision of the hook and loop combination (94) allows each of the air units (92) to be removable relative to the base (90) so that the user is able to freely adjust the area without any of the air units (92). Each air unit (92) is independent to the others and has an air nozzle (not shown) on a bottom face of the air unit (92) so that the user is able to respectively inflate the air units (92) one by one. Although the user has the ability to rearrange an area without any of the air units (92), the user still has to go through a great deal of trouble to inflate each one of the air units (92), which is quite troublesome and labor inefficient. Besides, after a period of time using the air cushioned bed, the air pressure inside the air units (92) will gradually drop. Thus, there should be someone, the nurses, to help the needed ones. However, the routine nursing work load of the nurses is already tiring, if helping the needed to inflate the deflated air units (92), either the air cushioned bed will be crushed for lack of tending or the nurse will quit job for too much work load.

A U.S. Pat. No. 6,321,404B1 issued to Tsai on Nov. 27, 2001 disclosed multiple independent inflatable units each having four air cells integrally formed with one another. The manufacturer is able to use multiple units to make a cushion suitable for bed, chair, etc. It is noted that an air nozzle is formed on a bottom face of each of the units so that the user is able to use an air pump to inflate each of the units simultaneously or respectively depending on the design of the air pump. Although the patent does leave a large freedom to the user to decide how many units are required to cope with the object intended to have the units mounted onto the object, because the location of the air nozzle is located at the bottom face of the unit, the manufacturer will have to further design a further space for receiving air ducts from the air pump so as to inflate the units when required, thus the air cushion is thick, which causes problem when shifting and storage.

To overcome the shortcomings, the present invention tends to provide an improved self inflated air cushioned bed to mitigate and obviate the aforementioned problems.

SUMMARY OF THE INVENTION

The primary objective of the present invention is to provide an improved self inflated air cushioned bed having multiple air units removably mounted on top of a base. Each of the air units have therein an expanding device so that after a load originally on top of the air unit is removed, the expanding device is able to inflate the air unit automatically via a unidirectional valve.

Other objects, advantages and novel features of the invention will become more apparent from the following detailed description when taken in conjunction with the accompanying drawings.

DETAILED DESCRIPTION OF THE PREFERRED EMBODIMENT

Figure 1:
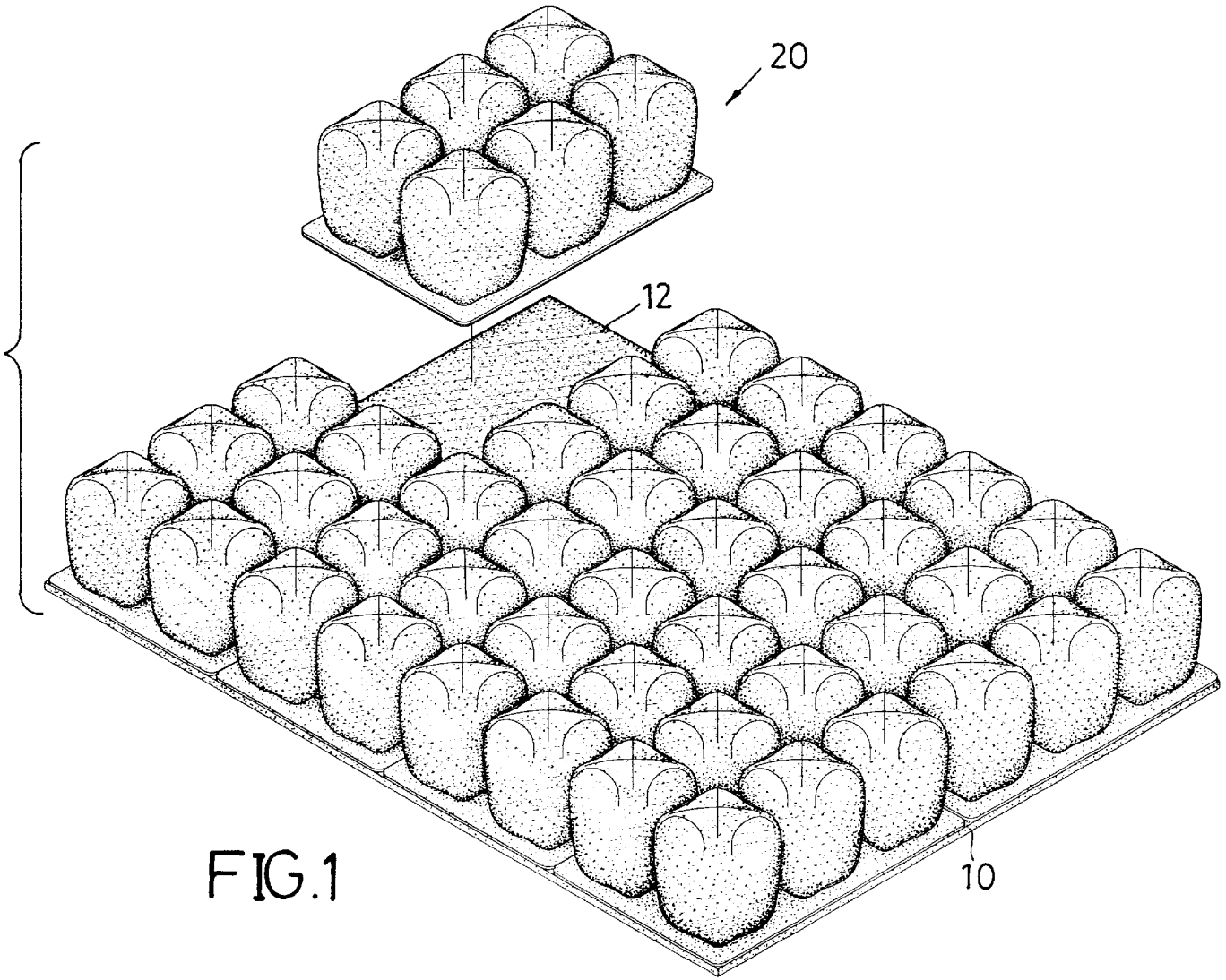
FIG. 1 is an exploded perspective view of the air cushioned bed of the present invention.
Figure 2A:
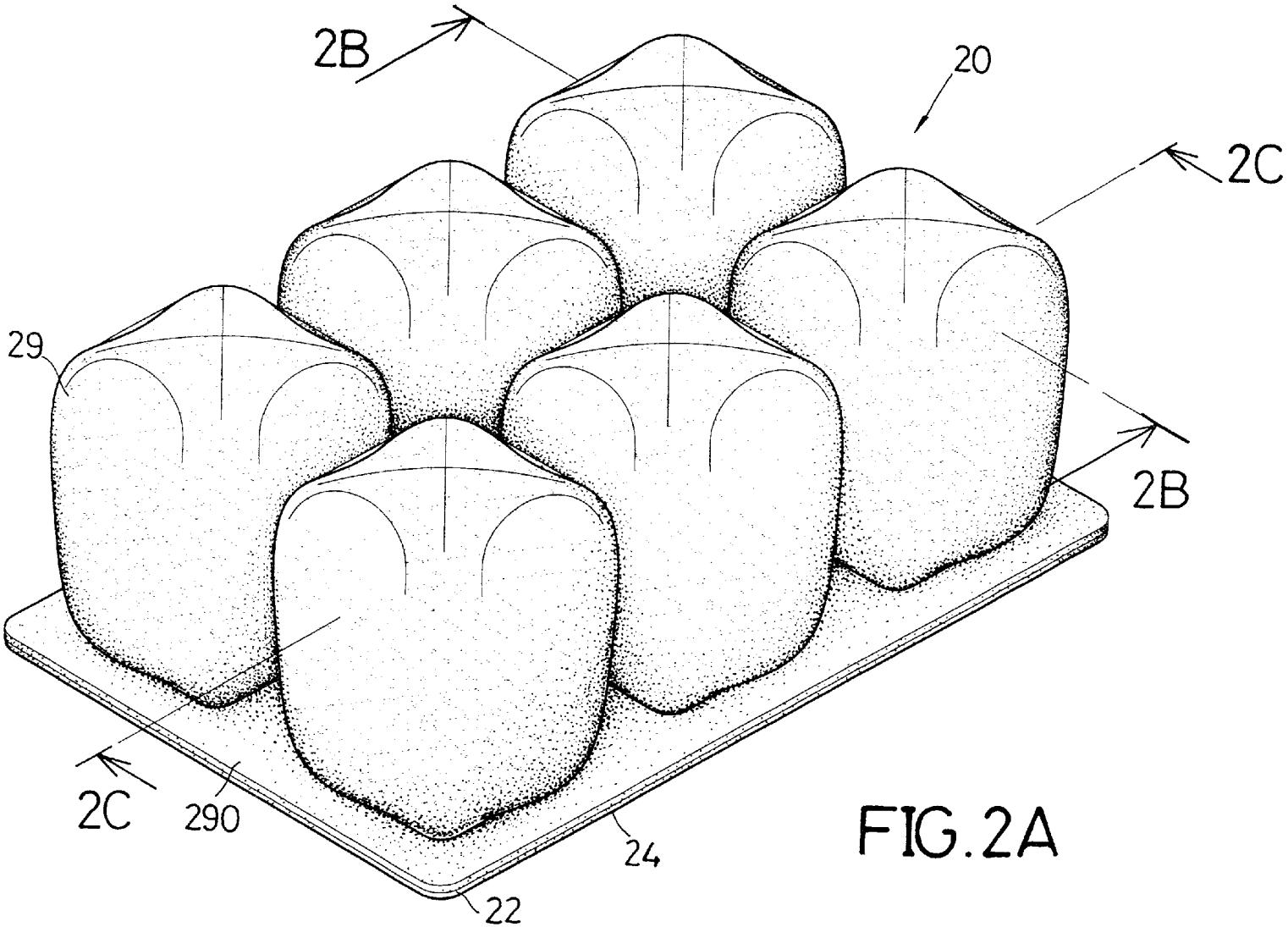
FIG. 2A is a perspective view of the air unit.
Figure 2B:
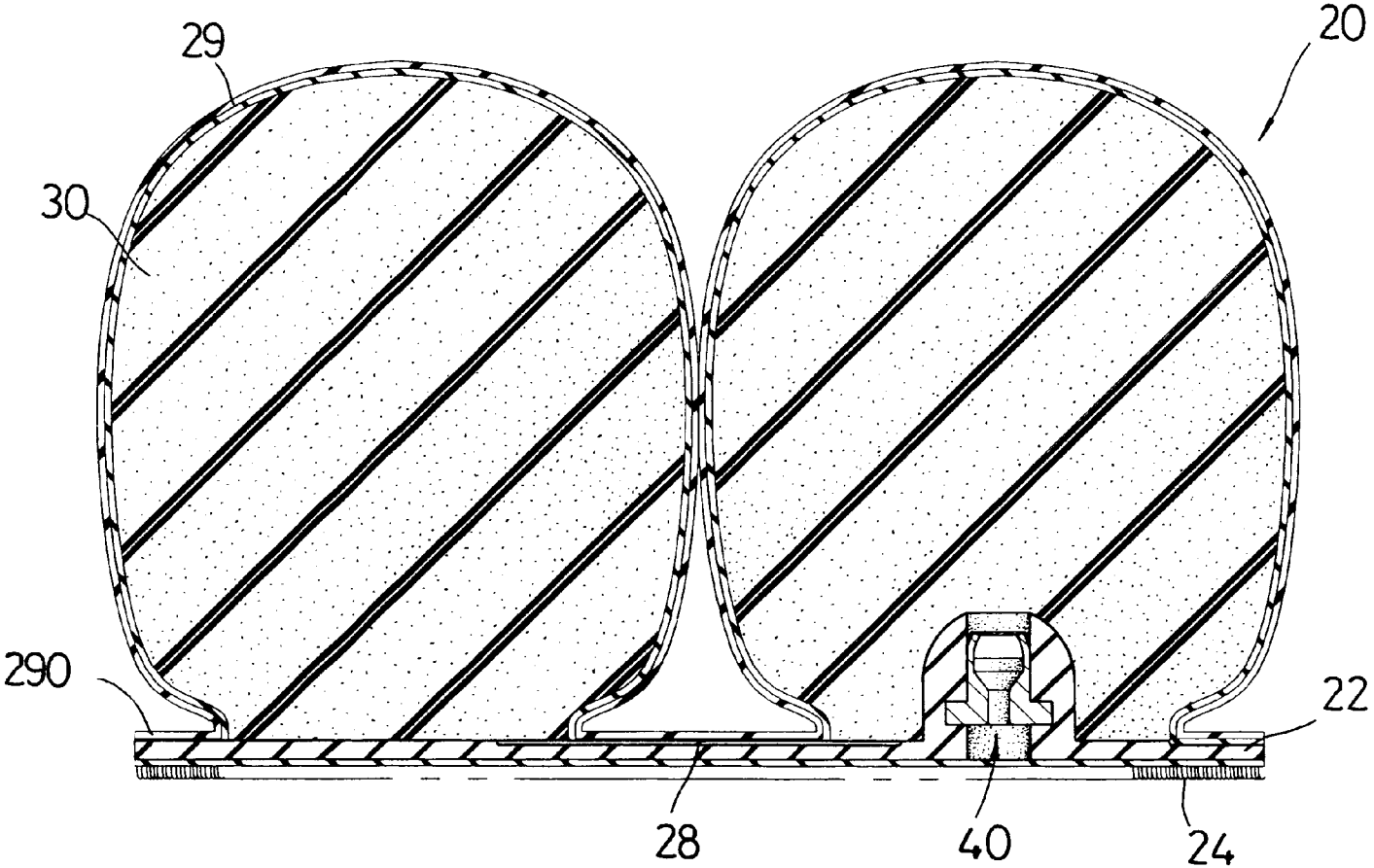
FIG. 2B is a cross sectional view of the air cell by taking the line 2B—B in FIG. 2A.
Figure 2C:
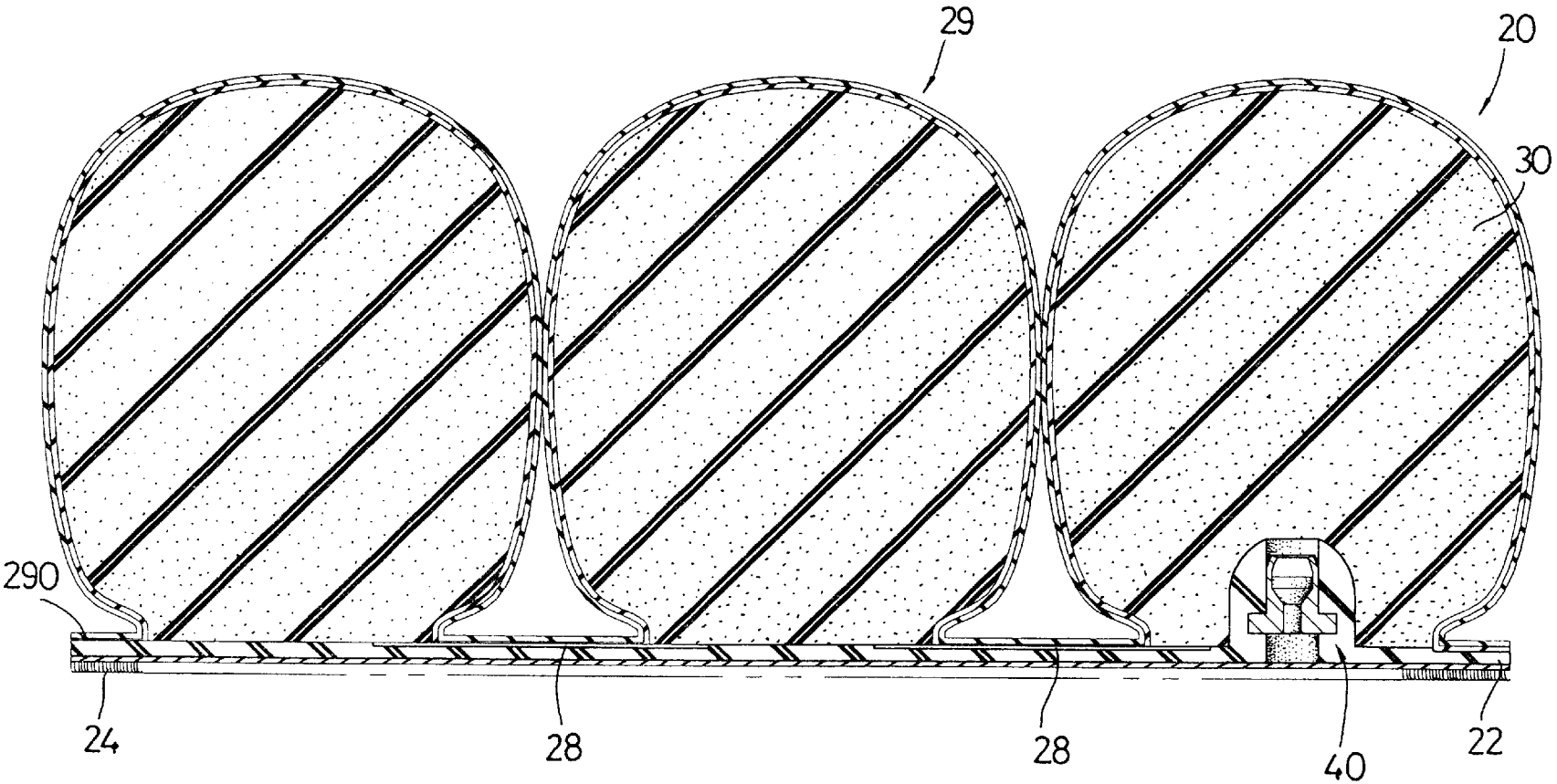
FIG. 2C is a cross sectional view of the air cell by taking the line 2C—C in FIG. 2A.

With reference to FIGS. 1, 2A, 2B and 2C, the self inflated air cushioned bed in accordance with the present invention has a base (10) and multiple air units (20) removably mounted on the base (10) via a first adhesion element (12) on the base (10) and a second adhesion element (24) as shown in FIG. 2B.

Each of the air units (20) include a substrate (22) and six air cells (29). Each air cell (29) has a skirt (290) integrally formed with the air cell to engage with a top face of the substrate (22) in an air tight manner and an expanding device (30) received inside the air cell (29). An air channel (28) is provided between two adjacent air cells (29). A unidirectional valve (40) is provided on the substrate.(22) so that the unidirectional valve is able to inflate the six air cells (29) simultaneously.

When the air cells (29) are mounted on the top face of the substrate (22) to form air units (20) and the air units (20) are mounted on top of the base (10) via the combination of the first adhesion element (12) and the second adhesion element (24), the expanding device (30) inside each of the air cells (29) is able to sustain the air cell (29) in a fully inflated state. Preferably, the expanding device (30) is a sponge or any object made of a resilient material. With such an arrangement of the air cushioned bed of the present invention, when there is a load on top of the air cushioned bed, the unidirectional valve (40) helps to prevent air leakage out of the air units (20). However, even if there is a leakage due to the loose structural integrity, the expanding device (30) is able to inflate the air cells (29) to allow air to inflow into each of the air cells (29) via the unidirectional valve (40).

Figure 3:
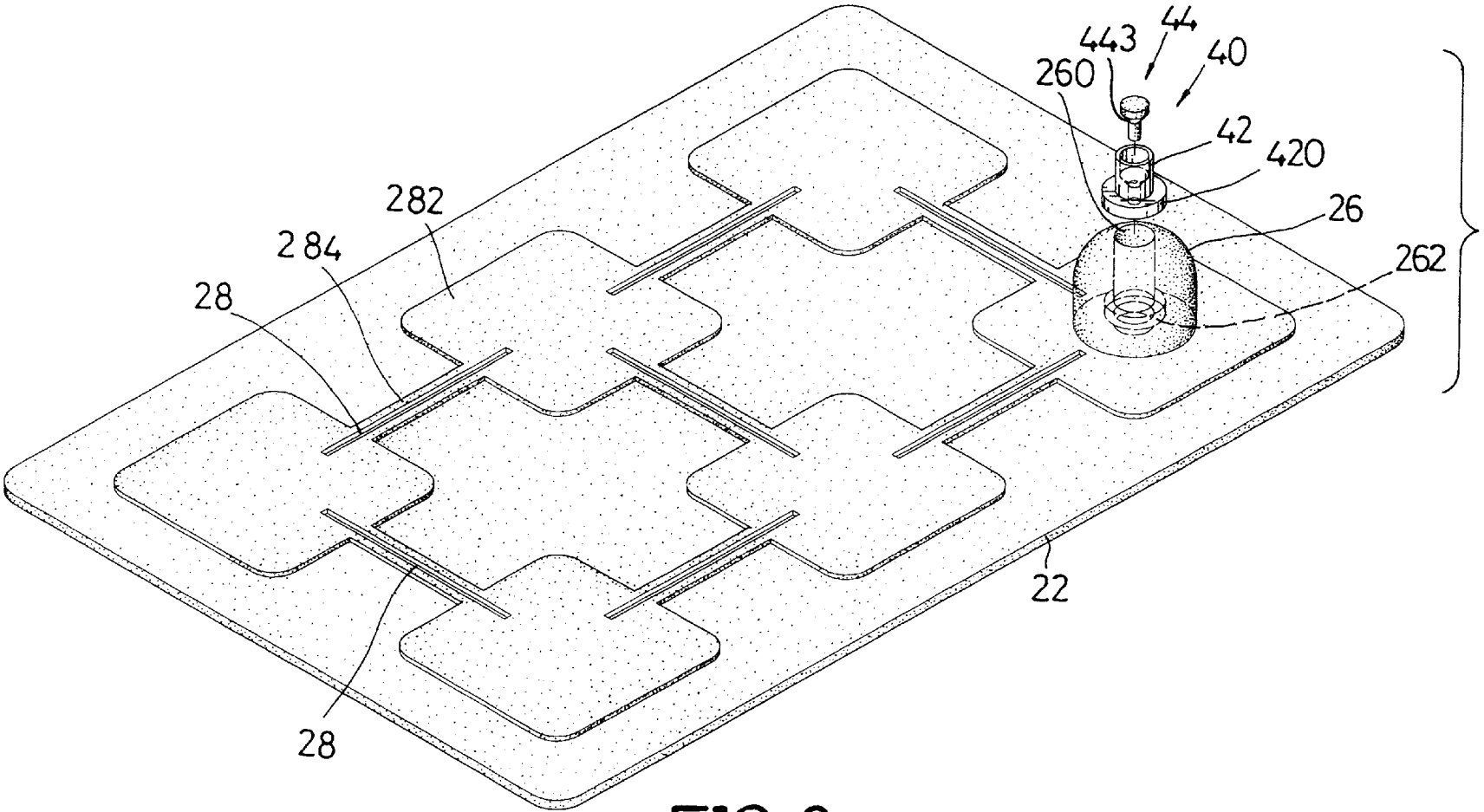
FIG. 3 is an exploded perspective view of the substrate and the unidirectional valve of the present invention.

To better understand the actual structure of the present invention, FIG. 3 shows that the substrate (22) has six protruded areas (282) to correspond to the six air cells (29) and a rib (284) is formed between two adjacent protruded areas (282). The air channel (28) is defined in each of the ribs (284). A seat (26) is formed on one of the protruded areas (282) and has an air path (260) defined through the seat (26), the protruded area (282) and the substrate (22). A mounting recess (262) is defined in the seat (26) to communicate with the air path (260).

Figure 4:
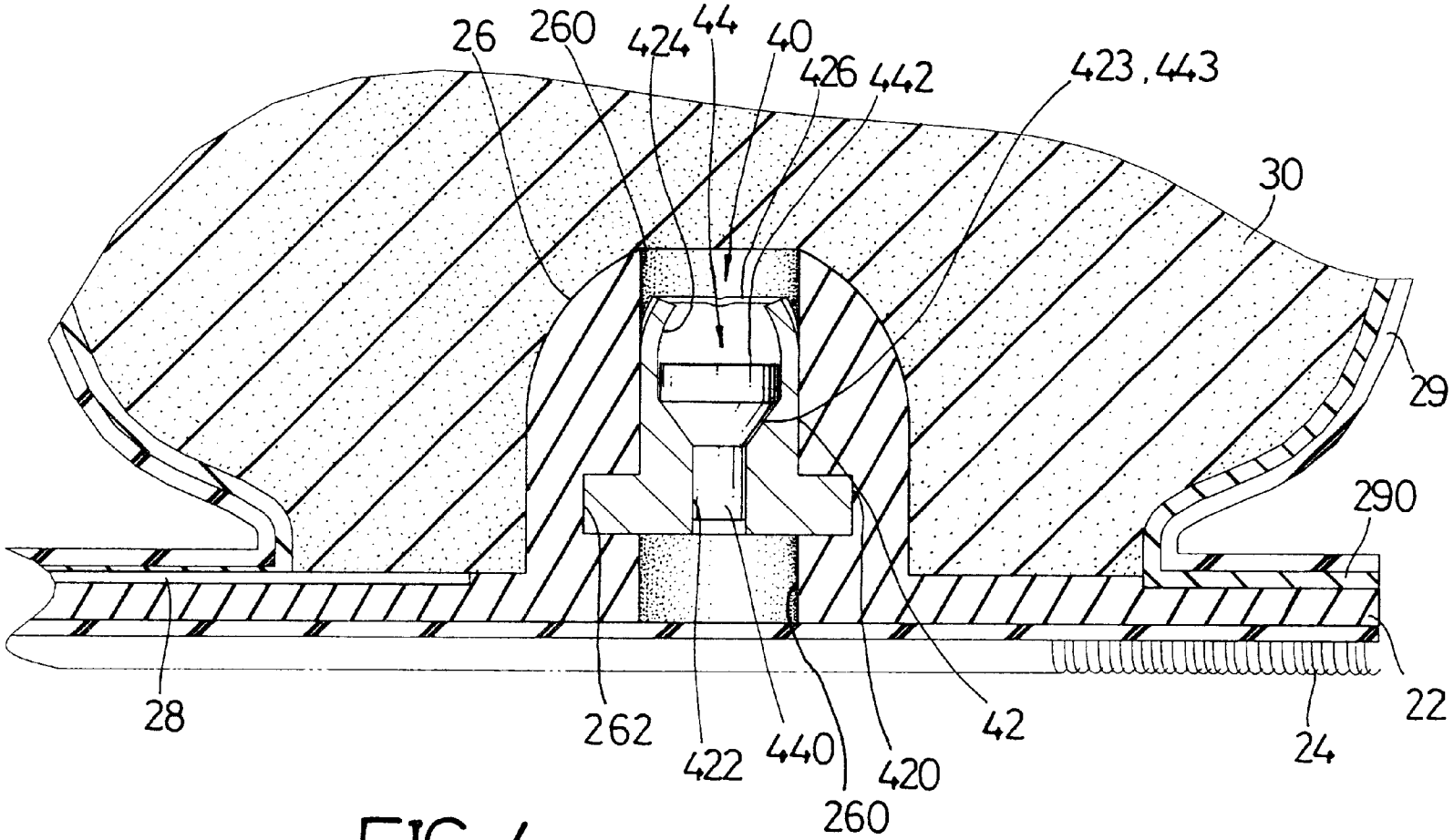
FIG. 4 is a schematic view showing that a load is on top of the air cell to force the plug of the unidirectional valve to block the air nozzle of the air cell to prevent leakage.

With reference to FIG. 4 and still taking FIG. 3 for reference, it is noted that the unidirectional valve (40) has a body (42) and a plug (44). The body (42) is provided with a flange (420) formed under the body (42) to correspond to the mounting recess (262) of the seat (26). An inlet (422) is defined in the body (42) to communicate with a plug receiving space (424) that has a diameter larger than a diameter of the inlet (422). A conical side face (423) is formed at a joint between the inlet (422) and the plug receiving space (424). The plug (44) has a head (442) movably received in the plug receiving space (424), a guide (440) formed with the head (442) to correspond to the inlet (422) and an abutting face (443) formed at a joint between the head (442) and the guide (440). Further, to prevent the plug (44) from leaving the plug receiving space (424), an upper periphery of the plug receiving space (424) is inwardly bent to form a reduced edge (426) such that when the plug (44) is moving inside the body (42), the reduced edge (426) is able to maintain the plug (44) inside the body (42). Therefore, when the flange (420) is received in the mounting recess (262) of the seat (26) and the plug (44) is received in the plug receiving space (424) of the body (42), the unidirectional valve (40) is assembled.

Figure 5:
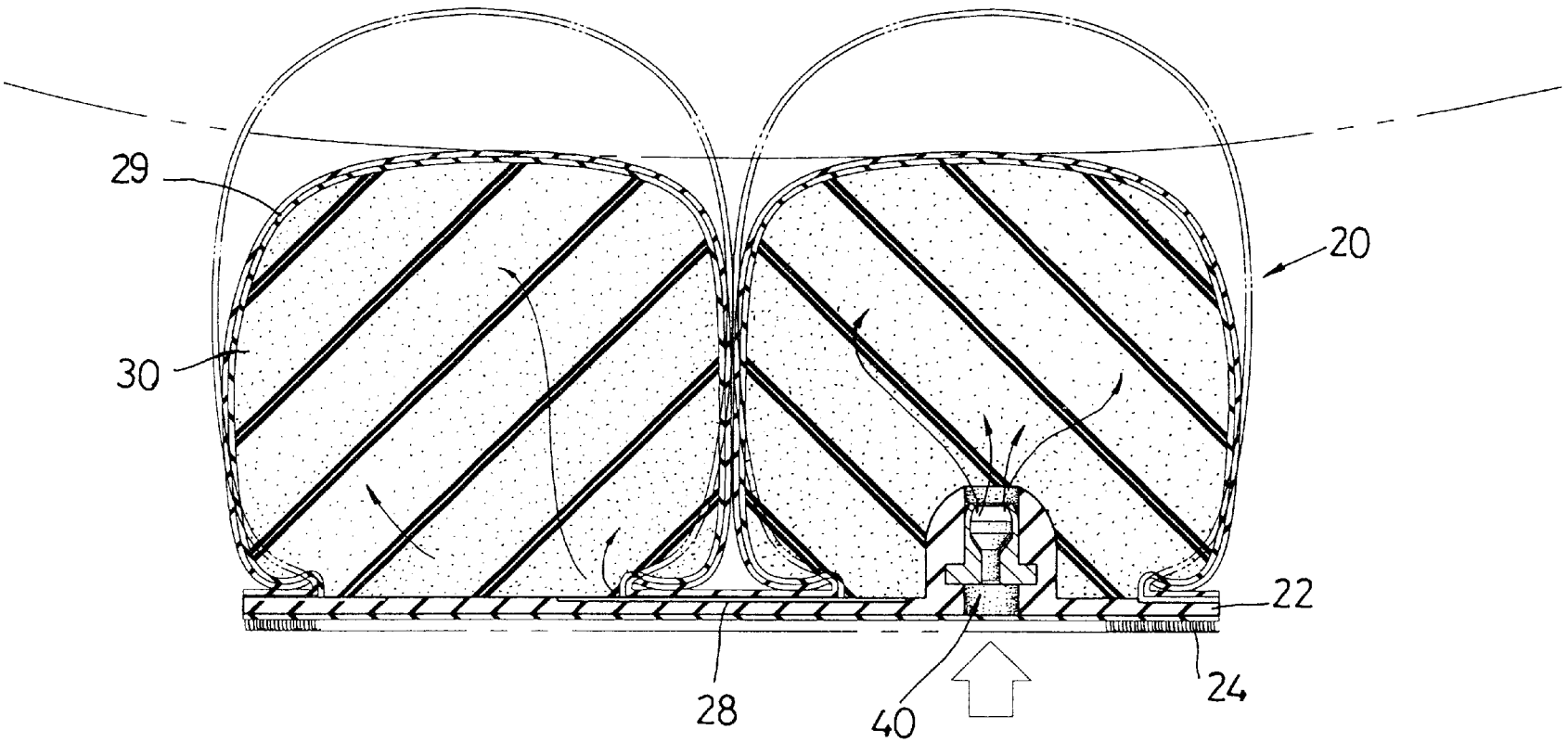
FIG. 5 is a schematic view showing that after the load on top of the air cell is removed, the expanding device inside the air cell helps the air cell to expand so that air automatically flows into the air cell.

With reference to FIG. 5 and still taking FIG. 4 for reference, because the air path (260) communicates with the inlet (422) of the body (42), when there is a load on top of the air units (20), the load will force the plug (44) to move downward in the body (42), which enables the abutting face (443) of the plug (44) to securely engage with the conical side face (423) and thus closes the communication between the air path (260) and the inlet (422). However, due to the loose structural integrity, more or less some of the air inside each of the air cells (29) will leak. With the load on top of the air cushioned bed and the leakage of air from the air cells (29), the air cells (29) are eventually and partially crushed.

However, due to the expanding device (30) inside each of the air cells (29), the partially crushed air cells (29) will be expanded so that during the expansion of the air cells (29), air flows through the unidirectional valve (40) to push away the plug (44) from engagement with the body (42) and into each of the partially crushed air cells (29) to inflate the air cells (29).

Figure 6:
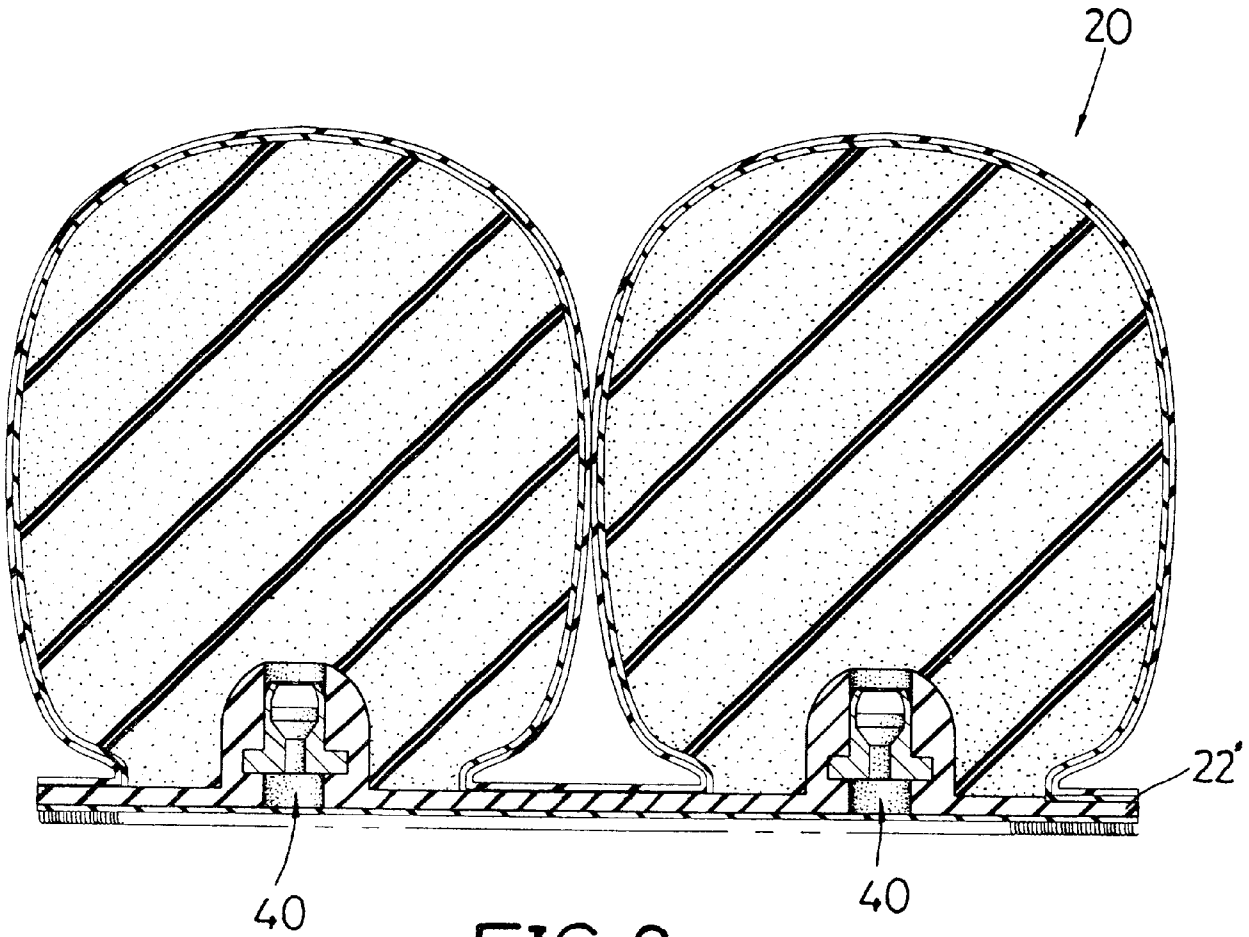
FIG. 6 is a second embodiment of the present invention, wherein each of the air cells is provided with a unidirectional valve.
Figure 7:
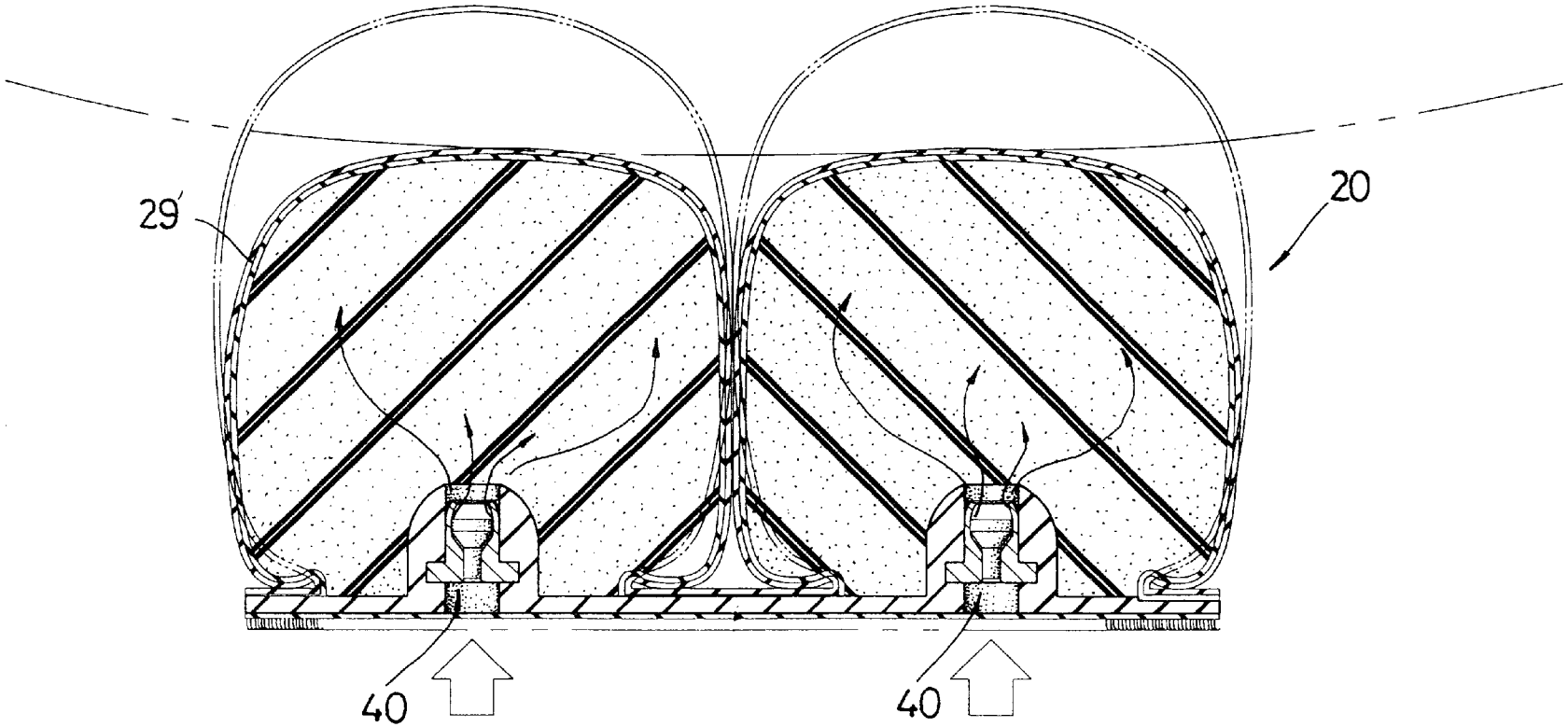
FIG. 7 is a schematic view showing the air flow inside the air cells in the second embodiment of the present invention.

With reference to FIGS. 6 and 7, it is noted that the substrate (22') has more than one unidirectional valve (40) so that the air cells (29') may be inflated by the two unidirectional valves (40) and the channel (28') may be omitted.

Figure 8:
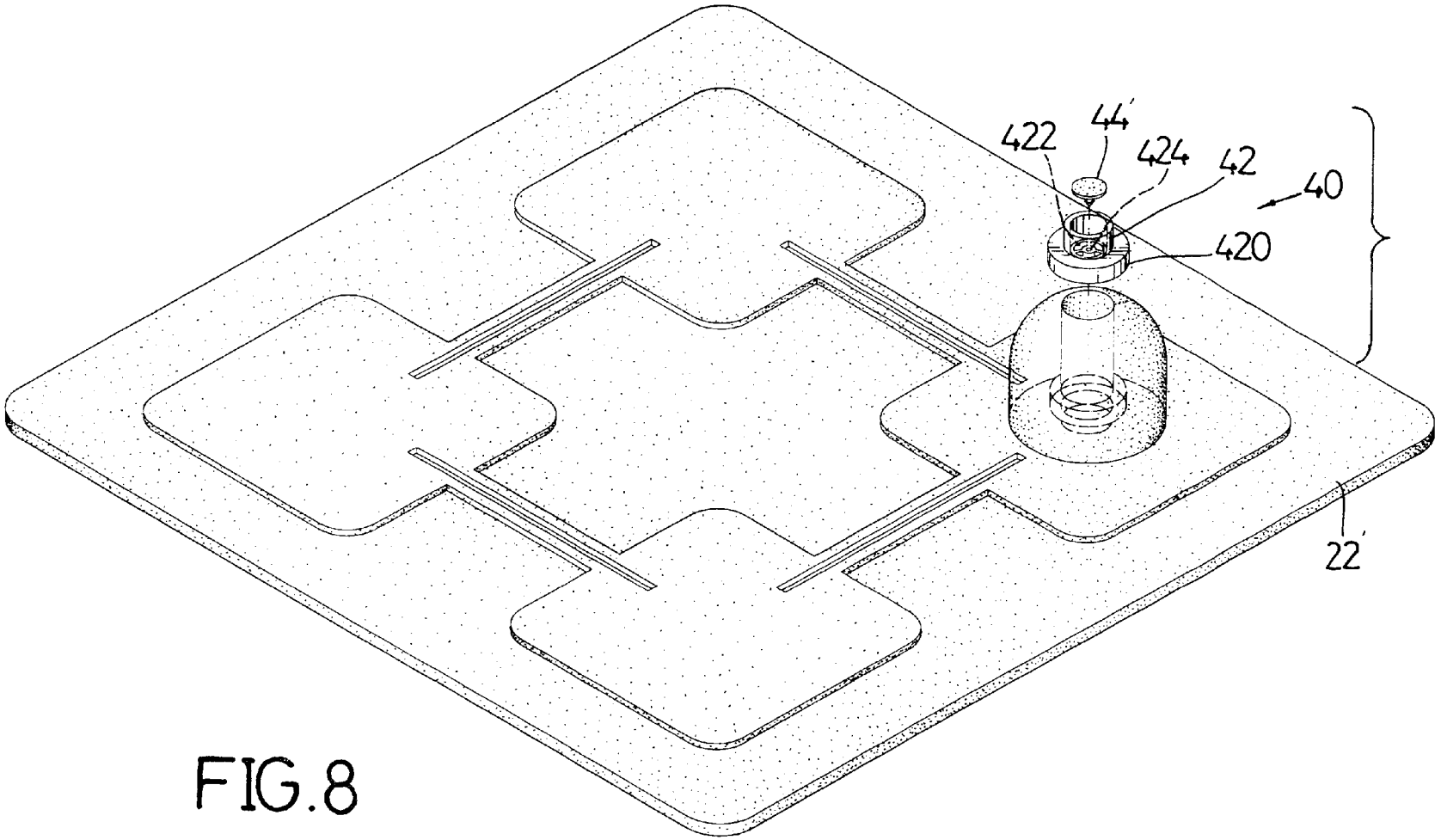
FIG. 8 is an exploded perspective view of the substrate and the unidirectional valve of another embodiment.
Figure 9:
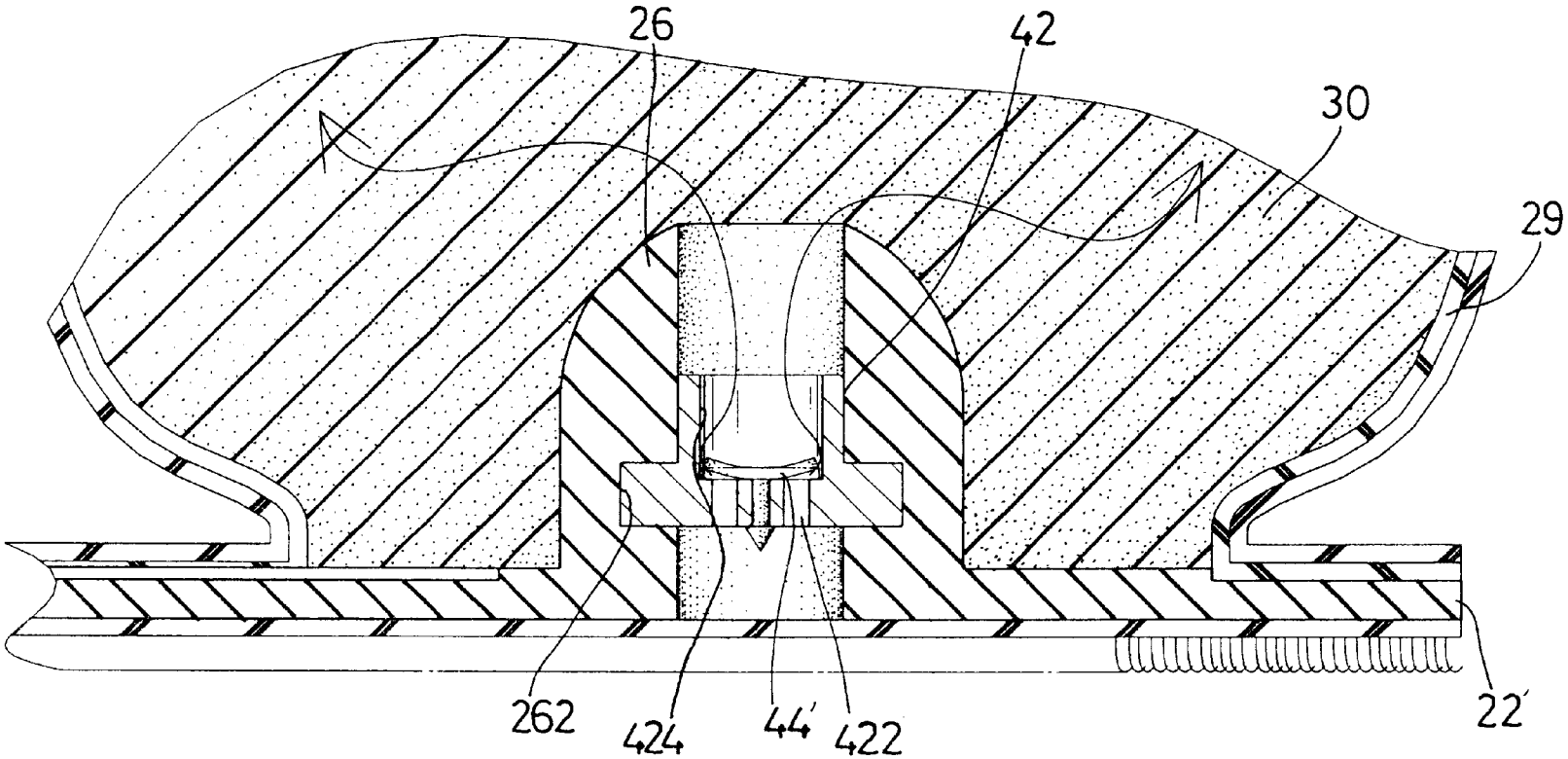
FIG. 9 is a schematic cross sectional view of the air flow in the embodiment in FIG. 8.
Figure 10:
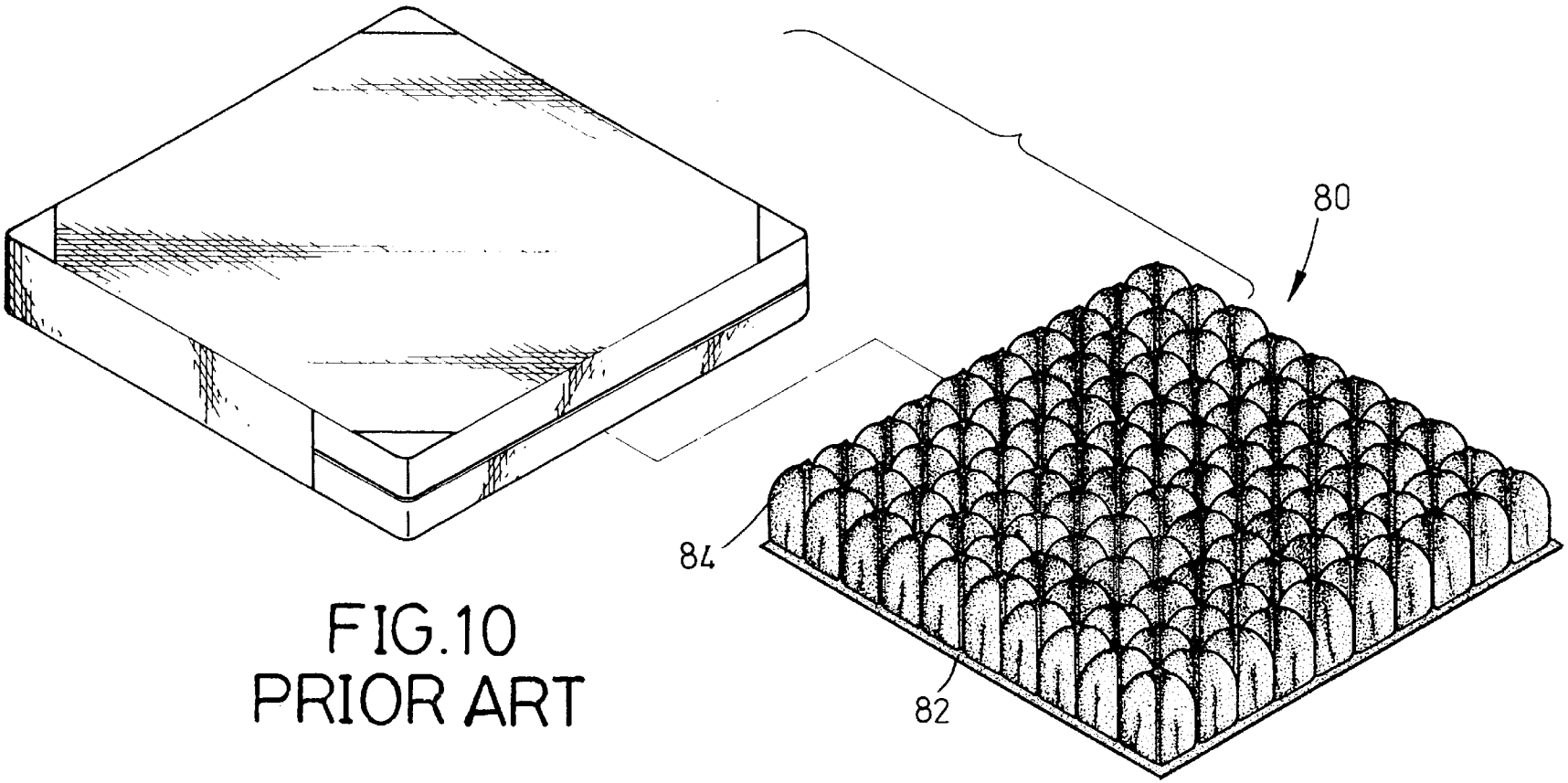
FIG. 10 PRIOR ART
FIG. 10 is an exploded perspective view of a conventional air cushioned bed.
Figure 11:
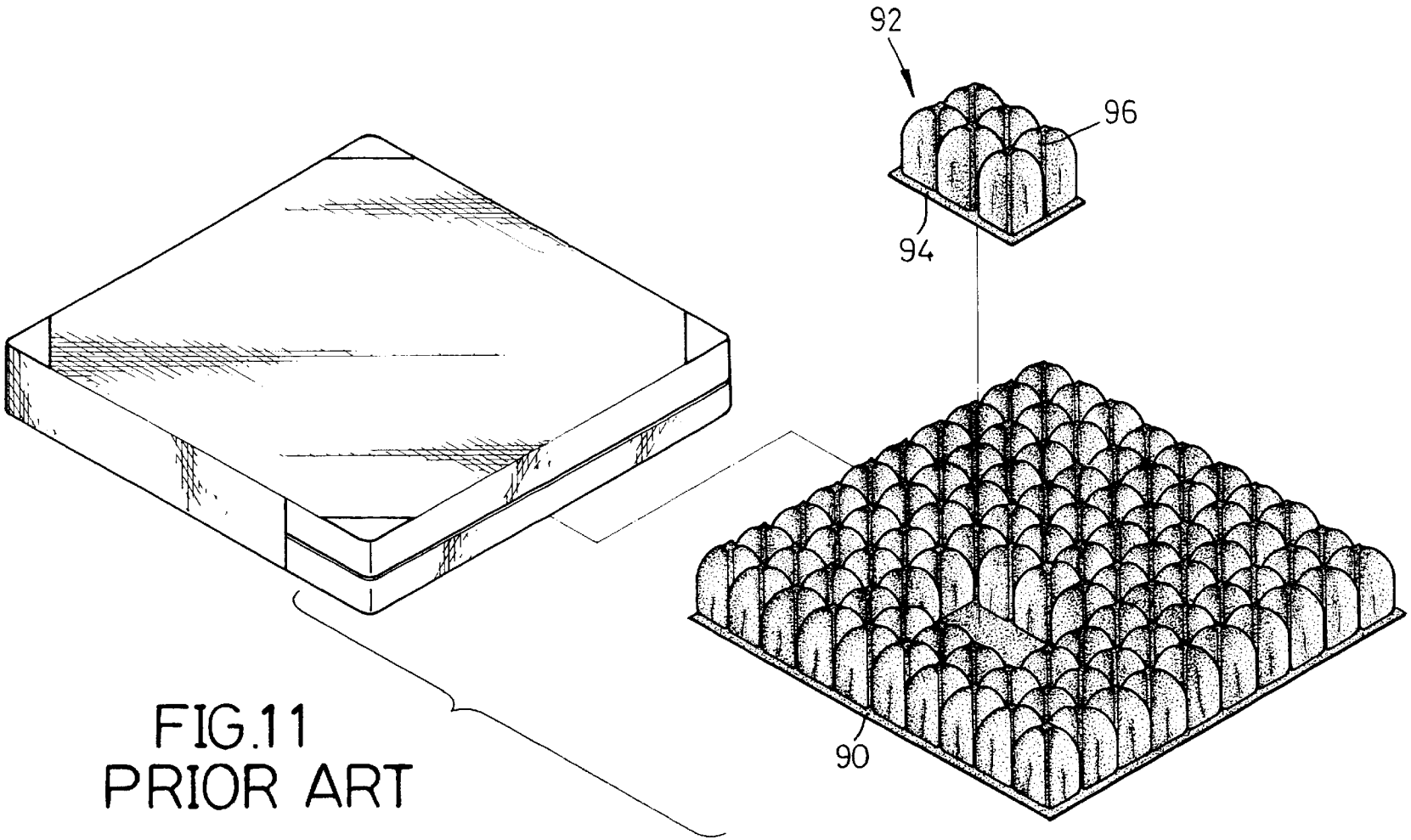
FIG.11 PRIOR ART
FIG. 11 is an exploded perspective view of another conventional air cushioned bed.

With reference to FIG. 8 and FIG. 9, it is noted that the plug (44') may be a deformable plate that is movably rested in the plug receiving space (424) of the body (42) to selectively block the communication between the inlet (422) and the plug receiving space (424). Therefore, when there is a load is on top of the air units (20), the load will force the deformable plate (the plug (44')) to block the communication between the inlet (422) of the body (42) and the plug receiving space (424). However, when the load is removed, the expanding device (30) in each of the air cell (29) is able to restore the air cells (29) by allowing air flowing into the air cells (29).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A self inflated air cushioned bed comprising:

a base having a first adhesion element attached to a top face of the base;

multiple air units each provided with at least two air cells securely mounted on top of a substrate that has a second adhesion element attached to a bottom face of the substrate to correspond to the first adhesion element so that the air units are removably mounted on top of the base;

at least one unidirectional valve mounted on the substrate to allow air to flow into the at least two air cells, the substrate having a seat formed on top of the substrate and having an air path defined through the substrate and the seat to receive therein the unidirectional valve and a mounting recess, the at least one unidirectional valve having a flange formed to correspond to the mounting recess so that the at least one unidirectional valve is mounted in the seat with the flange received in the corresponding mounting recess; and an expanding device received in each one of the at least two air cells in each of the multiple air units to maintain the at least two air cells in each of the air units to be expanded, whereby when the at least two air cells of each of the air units are expanded due to the expanding device, the at least one unidirectional valve allows air to flow into the at least two air cells of each of the air units so that the air units are maintained inflated.

2. The self inflated air cushioned bed as claimed in claim 1, wherein the at least one unidirectional valve has a body with a flange formed on a bottom of the body, an inlet defined in the body to communicate with the air path of the seat thereby to allow air outside the air cells to flow into the inlet and air inside the air cells to flow outside the air cells, and a plug movably received in a plug receiving space defined in the body to communicate with the inlet and the air path, whereby when the plug engages a joint between the plug receiving space and the inlet, the plug stops the communication between the plug receiving space and the inlet so that air flowing out of the at least two air cells of each of the air units is blocked.

3. The self inflated air cushioned bed as claimed in claim 2, wherein the plug is a deformable plate selectively blocking the communication between the inlet and the plug receiving space.

4. The self inflated air cushioned bed as claimed in claim 2, wherein the plug has a head received in the plug receiving space and a guide integrally formed with the head and received in the inlet, wherein an abutting face is formed to correspond to a conical side face formed at the joint.

5. The self inflated air cushioned bed as claimed in claim 2, wherein the substrate has an air channel between and communicating with two adjacent air cells so that air flowing into the air path in one of the at least two air cells is able to flow into the other air cell of the at least two air cells.

6. The self inflated air cushioned bed as claimed in claim 5, wherein the substrate has at least two protruded areas formed to correspond to the at least two air cells and ribs each formed between two adjacent protruded areas, wherein the air channels are respectively defined in a corresponding one of the ribs and communicate with the at least two adjacent air cells.

7. The self inflated air cushioned bed as claimed in claim 1, wherein the substrate has an air channel between and communicating with two adjacent air cells so that air flowing into the air path in one of the at least two air cells is able to flow into the other air cell of the at least two air cells.

8. The self inflated air cushioned bed as claimed in claim 7, wherein the substrate has at least two protruded areas formed to correspond to the at least two air cells and ribs each formed between two adjacent protruded areas, wherein the air channels are respectively defined in a corresponding one of the ribs and communicate with the at least two adjacent air cells.

* * * * *